US006209454B1

(12) United States Patent
Christmann et al.

(10) Patent No.: US 6,209,454 B1
(45) Date of Patent: Apr. 3, 2001

(54) MULTICOLOR ROTOGRAVURE ROTARY PRESS WITH FIRST AND SECOND SIDE PRINTING TOWERS

(75) Inventors: Dieter Christmann, Nürnberg; Hans-Dieter Drumm, Rammelsbach; Rudolf Herb, Bobenheim/Roxheim; Werner Georg Roman Straubinger, Nürnberg, all of (DE)

(73) Assignees: Koenig & Bauer Aktiengesellschaft, Wurzburg; U.E. Sebald Druck und Verlag GmbH, Nuremberg, both of (DE)

( * ) Notice: Subject to any disclaimer, the term of this patent is extended or adjusted under 35 U.S.C. 154(b) by 0 days.

(21) Appl. No.: 09/403,782

(22) PCT Filed: May 2, 1998

(86) PCT No.: PCT/DE98/01211

§ 371 Date: Jan. 20, 2000

§ 102(e) Date: Jan. 20, 2000

(87) PCT Pub. No.: WO98/50232

PCT Pub. Date: Nov. 12, 1998

(30) Foreign Application Priority Data

May 5, 1997 (DE) ..... 197 18 587

(51) Int. Cl.[7] ..... B41F 9/02

(52) U.S. Cl. ..... 101/152; 101/176; 101/179; 101/180; 101/181; 101/221

(58) Field of Search ..... 101/152, 156, 101/176, 179, 180, 181, 220, 221, 222, 223, 230

(56) References Cited

U.S. PATENT DOCUMENTS

| | | | | |
|---|---|---|---|---|
| 1,640,977 | * | 8/1927 | Brueshaber | 101/180 |
| 1,738,324 | * | 12/1929 | Scott | 101/222 |
| 2,104,026 | | 1/1938 | Dowell | 101/180 |
| 2,319,853 | * | 5/1943 | Durham | 101/181 |
| 5,483,887 | * | 1/1996 | Grosshauser | 101/181 |
| 5,564,336 | * | 10/1996 | Straubinger et al. | 101/152 |

FOREIGN PATENT DOCUMENTS

| | | | |
|---|---|---|---|
| 202875 | | 2/1939 | (CH) . |
| 0598240 B1 | | 5/1994 | (EP) . |
| 813971 | * | 12/1997 | (EP) . |
| 630941 | | 12/1927 | (FR) . |
| 56-137968 | * | 10/1981 | (JP) ..... 101/180 |

* cited by examiner

*Primary Examiner*—Daniel J. Colilla
(74) *Attorney, Agent, or Firm*—Jones, Tullar & Copper, PC

(57) ABSTRACT

In a rotary rotogravure printing press for accomplishing the multicolor printing of first and second sides of a material to be printed, first side printing units and second side printing units are arranged in an alternating form. Dryers are located between the alternating first and second material side printing units, which may be configured as tower printing units.

2 Claims, 1 Drawing Sheet

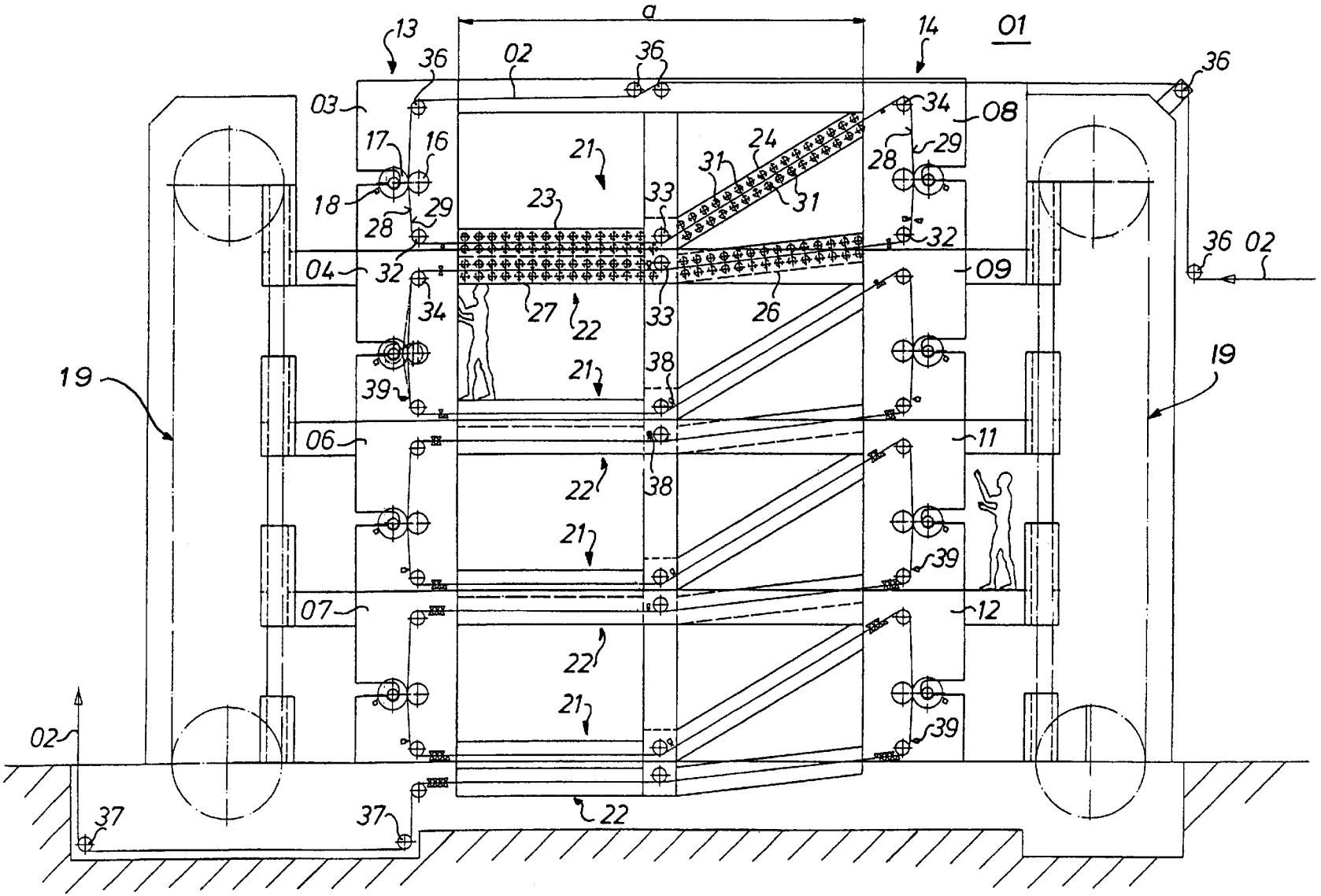
01
02
03
04
06
07
08
09
11
12
13
14
16
17
18
19
21
22
23
24
26
27
28
29
31
32
33
34
36
37
38
39
a

MULTICOLOR ROTOGRAVURE ROTARY PRESS WITH FIRST AND SECOND SIDE PRINTING TOWERS

FIELD OF THE INVENTION

The invention relates to a rotogravure printing process and to a rotary rotogravure printing press. Several printing are arranged one above the other in a tower structure for multicolor printing of both sides of a web. The printing units are arranged to print alternating sides of the material being printed.

DESCRIPTION OF THE PRIOR ART

EP 0 598 240 B1 describes a rotary rotogravure printing press with eight rotogravure printing units in a tower construction for multicolor first or obverse side and or reverse side second printing.

Swiss Patent 202 875 discloses a rotary rotogravure printing press, wherein a web is alternatingly printed on the front and back. A limitation of this prior art device is that the web paths between the individual printing units are of different length.

U.S. Pat. No. 2,104,026, discloses a rotary letter press for newspaper printing, wherein a web is alternatingly printed in multiple colors in a first and a second printing.

SUMMARY OF THE INVENTION

The present invention is based on the object of providing a rotary rotogravure printing press.

In accordance with the invention, this object is attained by the provision of a rotary rotogravure printing press that uses several printing units arranged one above the other in a tower structure. The printing press accomplishes multicolor printing of the first and second, or obverse and reverse surfaces of a material to be printing. The material travels between alternating first and second side printing units which are each separated by dryers.

The advantages which can be obtained by means of the present invention lie, in particular, in that with a preset structural height it is possible to use selective lengths of the dryers. The web travel path between two successive printing operations performed on one side of the web is twice as long compared to prior art presses, wherein first one side is completely printed and then the other side is completely printed. In this way, the quality of the successive colors is increased, or the length of the dryers arranged between two printing units is reduced.

Moreover, a construction which is compact and advantageous for the change of the form cylinder is made possible by the present invention.

BRIEF DESCRIPTION OF THE DRAWINGS

A preferred embodiment of the present invention is represented in the solo drawing FIGURE and will be described in greater detail in what follows.

DETAILED DESCRIPTION OF THE PREFERRED EMBODIMENTS

A rotary rotogravure printing press 1 for multicolor printing on both first and second or second or obverse and reverse sides of a material to be printed, for example a web 02, has at least four and may have, for example eight printing units 03, 04, 06, 07, 08, 09, 11, 12. Four of these printing units such as units 03, 04, 06, 07, or printing units 08, 09, 11, 12, are arranged above each other in a so-called tower structure. In this configuration the printing units, which are located horizontally opposite each other, 03, 08, or respectively 04, 09, or respectively 06, 11, or respectively 07, 12 are arranged in a mirror-reversed manner with respect to each other. The four left printing units 03, 04, 06, 07, for example, form a printing tower 13 for first or obverse side printing and, the four right printing units 08, 09, 11, 12 form a printing tower 14 for second or reverse side of web 02 printing. In the depicted preferred embodiment, the distance a between the printing tower 13 for first web side printing and the printing tower 14 for second web side printing is approximately 6 m.

Each printing unit 03, 04, 06, 07, 08, 09, 11, 12 has an impression cylinder 16 and an exchangeable forme cylinder 17, provided with a rotogravure forme, as well as an ink application device 18.

For the automatic exchange of the forme cylinders 17, an elevator 19, designed as a "paternoster", for transporting the forme cylinders 17 is assigned to each of the respective printing towers 13, 14 for first and second web side printing.

A dryer 21, 22 is respectively arranged between the 28 printing units 03, 08, or respectively 04, 09, or respectively 06, 11, or respectively 07, 12. Each of the dryers 21 or 22 with the same web running direction are identically constructed. The dryers 21, which dry the web 02 running from left to right, each have a first, horizontally arranged section 23. A second upwardly inclined section 24, which rises diagonally from left to right, adjoins this first, horizontal section 23 of each left to right web travel direction dryer 21.

With the dryers 22, which dry the web running from right to left, a first section 26 is arranged to be downwardly inclined from right to left. An adjoining second section 27 is arranged to extend horizontally. Each dryer 21, 22 has blower nozzles 31, which are assigned to both sides 28, 29 of the web 02. Alternatively it is also possible to arrange an IR drying device, or respectively a microwave drying device with an inert gas lock. A guide roller 32, 33, 34, which reverses the web 02, is respectively provided ahead of, between and following the two sections 23 and 24 or 26 and 27 of the first and second dryers 21, 22.

The web 02 to be printed is conveyed from above by a cylinder changer, not represented, via guide rollers 36 to the first printing unit 03 of the printing tower 13 for first printing. A first side 28 of the web 02 is printed with a first color between the impression cylinder 16 and the forme cylinder 17 in this first printing unit 03.

Following this first printing, the web 02 leaving the bottom of the first printing unit 03 is delivered via a guide roller 32, which operates in contact with the unprinted second or reverse side 29 of the web 02, to the first section 23 of the first dryer 21. After the web 02 emerges from the first section 23 of the first dryer 21, a guide roller 33, which operates together with the unprinted second side 29 of the web 02, guides the web 02 into the second inclined section 24 of the dryer 21.

A guide roller 34 is arranged downstream of the exit of the web 02 from the second, inclined section 24 of the first dryer 21. This guide roller 34 now conducts the dried web 02 from above to a first printing unit 08 of the printing tower 14 for second or reverse web side printing. This guide roller 34 acts on, i.e. contacts, for the first time the first printed side 28 of the web 02 after the web 02 has left the first printing unit 03 of the printing tower 13 for first printing. Thus, the freshly printed first side 28 is contacted for the first time after the dryer 21 by a guide element.

A guide roller 32, which works together with or contacts the first or obverse printed side 28 of the web 02 and guides the web 02 into a first declined section 26 of the second dryer 22, is arranged downstream, viewed in the running direction of the web 02, of the first printing unit 08 of the printing tower 14 for second printing. A guide roller 33, which works together with the first or obverse printed side 28 of the web 02, guides the web 02 into the second horizontal section 27 of the second dryer 22. This guide roller 33 is arranged following the first section 26 of the second dryer 22. A guide roller 34, which works together with the second printed side 29 of the web 02, is arranged downstream of the second dryer 22. This guide roller 34 conducts the web 02 from above to the second printing unit 04 of the printing tower 13 for first printing. The first printed side 28 of the web 02 is printed with a second color in this second printing unit 04.

Printing and drying of the web 02 in the further printing units 04, 06, 07, or respectively 09, 11, 12 of the printing tower 13 for first or obverse side printing and in the printing tower 14 for second or reverse web side printing takes place in accordance with the above described operations of the respective first printing unit 03, or respectively 08, of the printing tower 13 for first printing and the printing tower 14 for second printing. Following the completed printing of the first and second printed sides 28, 29 of the web 02, the web 02 is conducted over guide rollers 37 to an optional final dryer and to a further processing device, not specifically represented, which may be for example, a folding apparatus or a winding device.

In place of the depicted rotary rotogravure printing press with eight printing units 03, 04, 06, 07, 08, 09, 11, 12 for four-color first and second or obverse and reverse printing, another number of printing units is also possible.

Dampening devices 38 for conditioning the web 02 can be associated with the dryers 21, 22. Register adjustment devices 39 can be provided between the printing units 03, 04, 06, 07, 08, 09, 11, 12.

In the rotary rotogravure printing press 01 in accordance with the present invention, the printing units 03, 04, 06, 07, 08, 09, 11, 12 have alternatingly printed a first or obverse printed side 28 and a second or reverse printed side 29 of the material to be printed 02, or vice versa.

While a preferred embodiment of a rotogravure printing press for multicolor printing of both obverse and reverse, or first and second sides of a web, in accordance with the present invention has been set forth fully and completely hereinabove, it will be apparent to one of skill in the art that a number of changes in, for example, the drive assemblies for the printing units, the web feed to the printing press and the like could be made without departing from the true spirit and scope of the present invention which is accordingly to be limited only by the following claims.

What is claimed is:

1. A rotary rotogravure printing press for multicolor printing of first and second sides of a web comprising:

at least two web first side printing units arranged one above the other in a web first side printing tower structure;

at least two web second side printing units arranged one above the other in a web second side printing tower structure spaced from and in opposition to said web first side printing units in said web first side printing tower, said web first side printing units in said web first first side tower structure and said web second side printing units in said web second side printing tower structure being arranged mirror-reversed to each other and each printing a first side or a second side of a web of material to be printed in an alternating manner as the web of material travels a path between alternating ones of said web first side printing units and said web second side printing units; and a separate dryer arranged between each said web first side printing unit and each said opposed web second side printing unit in said path of web travel.

2. The rotary rotogravure printing press of claim 1 wherein said web first side printing tower structure includes at least three of said web first side printing units, and said web second side printing tower structure includes at least three of said web second side printing units.

* * * * *